United States Patent [19]

Elsner

[11] 4,170,712

[45] Oct. 9, 1979

[54] TILTABLE ARC FURNACE

[75] Inventor: Emil Elsner, Baden-Baden, Fed. Rep. of Germany

[73] Assignee: Korf-Stahl AG, Baden-Baden, Fed. Rep. of Germany

[21] Appl. No.: 913,060

[22] Filed: Jun. 6, 1978

[30] Foreign Application Priority Data

Jun. 7, 1977 [DE] Fed. Rep. of Germany ..... 2725686

[51] Int. Cl.[2] ..... H05B 7/11

[52] U.S. Cl. ..... 13/10

[58] Field of Search ..... 13/9, 10, 12

[56] References Cited

U.S. PATENT DOCUMENTS 2,944,099 7/1960 Sernitz et al. ..... 13/10

*Primary Examiner*—Roy N. Envall, Jr.

[57] ABSTRACT

An arc furnace which is supplied by means of alternating current by way of heavy-current conductors, with liftable electrode carrier arms, wherein the heavy-current conductors can be separated from each other by means of releasable electrical couplings.

9 Claims, 6 Drawing Figures

TILTABLE ARC FURNACE

Figure 1:
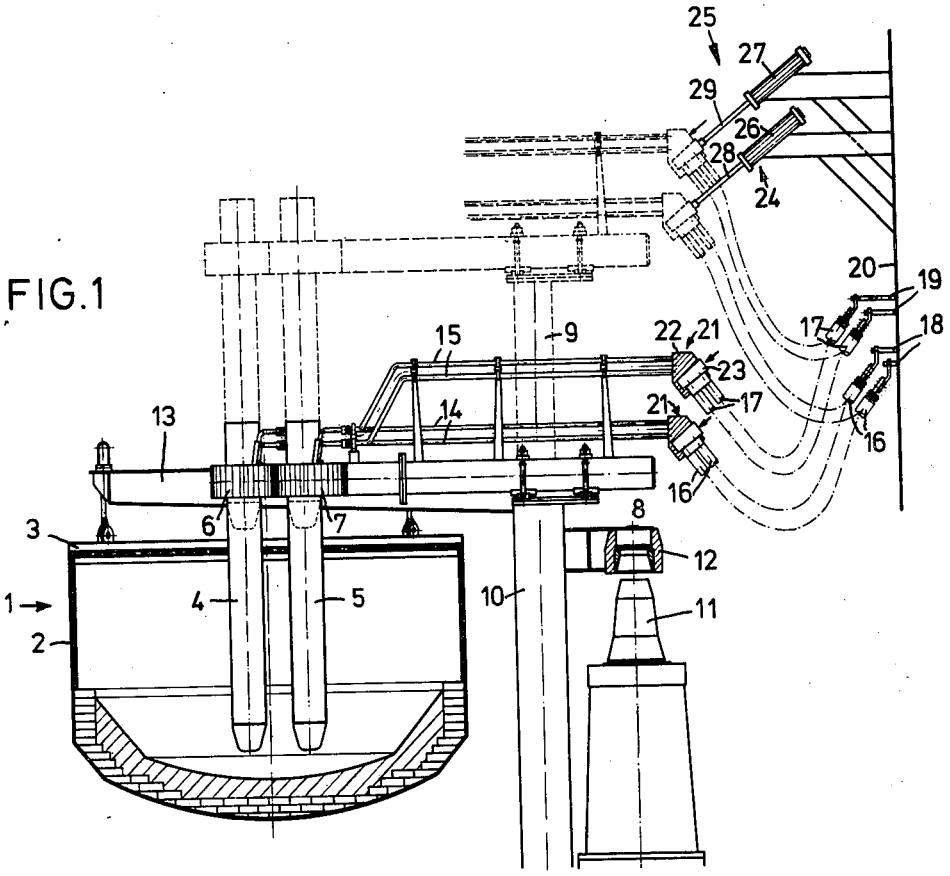

The invention relates to an arc furnace and, more specifically, to a tiltable arc furnace supplied with alternating current by means of heavy-current conductors that are flexible at least in part.

It has recently been recognized that a low level of reactance is an important pre-requisite in the electrical power supply to arc furnaces. For example, the so-called refractory index, which is a measurement of the thermal loading of the refractory walls, increases with the square root of the reactance X. With the same power and the same cos $\phi$, low reactance makes it possible to produce an arc which is shorter and which therefore has a higher level of electrical power per unit of length of the arc. This results in an improvement in the degree of heating effect of the arc, and the consumption of refractory material and electrical energy falls. A low level of reactance is therefore an essential requirement for a good furnace construction.

In recent times, a furnace construction has proved a success, in which the cover and electrode carrier arms can be swung away by means of a main pivot, being in part additionally supported on rails.

In such furnaces, the cables must be of such dimensions that they accommodate the upward and downward movements of the electrode arms and permit the tilting movements of the furnace for the purposes of slagging off (maximum of 10° to 15°) and for the purposes of tapping (maximum of from 40° to 45°). In such furnaces, the total reactance of the electrical heavy-current system is divided up approximately as follows:

| | |
|---|---|
| Transformer | 8% |
| Rails leading to the flexible cables | 5% |
| Flexible cables | 30–40% |
| Heavy-current conduits | 25% |
| Electrodes | 17.5% |
| Arc | <2% |

and is about 3 mΩ, in the larger sizes of arc furnaces. These measurement results show that the reactance of the flexible cables is the highest, at about 35%, and is about 1.1 mΩ in the system under consideration.

A furnace construction has been made known, in which the transformer also stands on the furnace rocking cradle and is tilted with the furnace. In this way the connecting cables can be kept short. However, in comparison with the above-mentioned construction, this construction has the disadvantage that firstly a very heavy weight must be tilted with the furnace, and in addition the sensitive transformer is exposed without protection to the heat and dust of the arc furnace. In addition there is the danger of fire.

In another construction, the transformers are so disposed that they are located off-center with respect to the tilting side of the furnace. This arrangement makes it possible for the cables to be shortened only slightly, so that it is not possible to achieve a substantial reduction in the reactance.

Furnace constructions have also been made known, in which the furnace is tilted by way of rollers over a curve. The pivot point is then disposed close to the vertical furnace axis, and it is possible to use shorter current cables with lower reactance. However, this method of construction is comparatively expensive, just like another known furnace construction, in which the furnace vessel is moved out of the electrode support before the furnace is tilted, so that short current cables can also be used.

It is an object of the invention, in furnace constructions in which the electrodes also perform the tilting movement, to reduce to the lowest possible level the total reactance of the electrical heavy-current system, that is to say, the supply system for the current supplied to the arc electrodes, that is to say, to keep the inductance of this system as low as possible.

This problem has been solved in accordance with the present invention by providing releasable couplings in the area of the bus bars connected to the electrode carrier arm and by providing at a stationary support actuating and holding means for grasping, uncoupling and holding the coupling pieces connected to the flexible cable.

The invention is based on the concept of constructing the heavy-current conductors in such a way that they can be separated during the periods of time in which no current has to be supplied to the electrodes, thus for example when tapping the furnace. In that case the cables no longer require the additional length which is necessary for performing the tilting movement of the furnace. For practical reasons, the uncoupling position is provided at the highest position of the electrode carrier arms. The greatest length of the cables is then only determined by the highest position of the electrode carrier arms. If the arc furnace is provided with a flat cover, it is possible for the cables to be further reduced in length, by about the height of the dome of the cover, as in that case the electrode arms no longer have to be raised as high. In this case the cables may be shortened in length by about 40%, that is to say, the reactance of the heavy-current system is reduced by about 14%.

Irrespective of the form of the cover, the greatest possible reduction in the length of the cables can be achieved when, upon raising the electrodes, the cables are already uncoupled at a position which is disposed directly above the highest position at which current must be supplied to the electrodes.

During the furnace tilting operation, the cables, or, if the uncoupling position is disposed in the region of the heavy-current bus bars, the ends of the heavy-current bus bars to which the cables are secured, are held by holding means which are mounted on the tower wall. If the uncoupling position is at the tower wall, the holding means may also be secured on the tiltable furnace.

Figure 2:
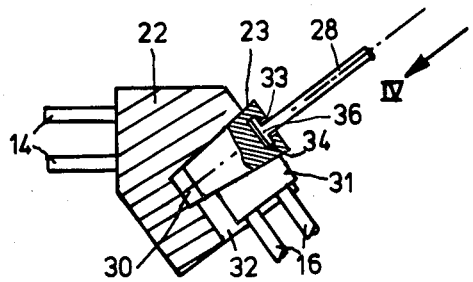
Figure 3:
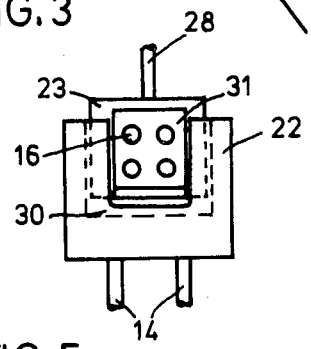
Figure 4:
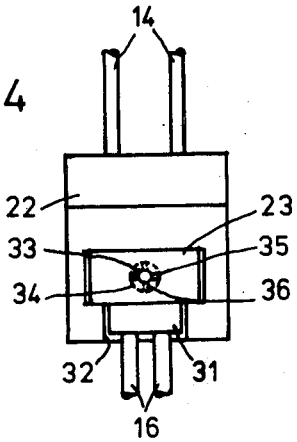
Figure 5:
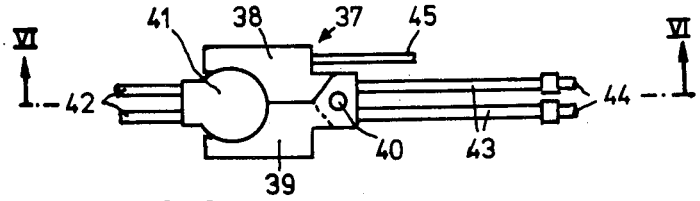
Figure 6:
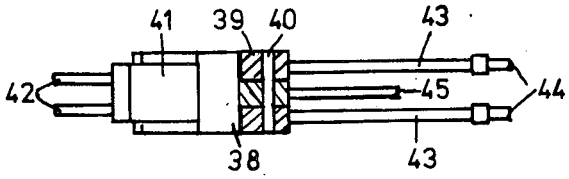

The invention is illustrated in greater detail by means of embodiments, with reference to six figures of drawings, in which:

FIG. 1 shows a view in partial cross-section of an arc furnace including the heavy-current conductors, FIGS. 2 to 4 show various views of an embodiment of a releasable coupling, FIGS. 5 and 6 show a further embodiment of a releasable coupling.

FIG. 1 shows a view in axial section of an arc furnace with a tiltable furnace vessel 2 and a cover 3 which can be swung away. Three arc electrodes 4 and 5 project downwardly into the furnace vessel 2, only two of the electrodes being shown in the sectional view in FIG. 1. The arc electrodes are carried in electrode carrying means 6 and 7 which are respectively mounted on electrode carrier arms 8, of which only one is shown in FIG. 1. Each of the electrode carrier arms is secured to a hydraulic piston 9 which is guided within a hydraulic cylinder 10 and which can be extended to the position shown in broken lines. The cover may be raised and swung away by means of a hydraulically liftable main pivot 11 which may be inserted into the mounting 12 of a cover carrier structure 13. The current supply to the electrodes 4 and 5 is by way of heavy-current conductors which are formed in part as heavy-current bus bars 14 and 15 fixedly mounted on the electrode carrier arms, and in part as flexible heavy-current cables 16 and 17 which are connected to the bus bars 14 and 15. The heavy-current cables are connected to connections 18 and 19 which are provided in a tower wall 20, and are connected to the feed transformer. In the present case, four heavy-current conductors are associated with each phase.

Usually in the above-described furnace construction the heavy-current cables 16 and 17 are fixedly connected to the heavy-current bus bars 14 and 15. When the furnace is tilted for slagging off or for tapping, the electrodes can be extended to the upper position shown in broken lines in FIG. 1, and, as the electrode arms are tilted at the same time with the furnace vessel, a relatively long additional length of heavy-current cable is required, so that the heavy-current cables do not impede the tilting movement.

For the purposes of reducing the total reactance in the arc furnace according to the invention the heavy-current conductors are separable from each other by means of releasable electrical couplings 21. Although in the embodiment illustrated the couplings are provided at the position of connection between the heavy-current bus bars and the cables, they may also be arranged in the end region of the heavy-current bus bars which carry the flexible heavy-current conductors.

The releasable couplings 21 comprise two portions, namely a receiving portion 22 and a plug portion 23, of which the receiving portion 22 is fixedly connected to the heavy-current bus bars 14 and 15 respectively, and the plug portion is fixedly connected to the heavy-current cables 16 and 17 respectively. Actuating and holding means 24 and 25 for the releasable couplings 21 are provided on the tower wall 20. The position of the actuating and holding means 24 and 25 is established in consideration of the position at which the couplings 21 are to be actuated. In the present case, this position is determined by the upper limit position of the electrode carrier arms 8. As already mentioned however, this position may also be somewhat lower. Separation of the releasable coupling may occur when the raised electrodes are just at a height which is above the operative range of the electrodes, that is to say, above the position at which current must be supplied to the electrodes by way of the heavy-current conductors, in order for the arc furnace to be operated. In the present case, the position of the actuating and holding means 24 and 25 is determined by the upper limit position of the electrode carrier arms 8; by virtue of using a furnace cover 3 of a flat configuration, this position is already substantially lower than in the case of an arc furnace which has a curved cover.

The actuating and holding means 24 and 25 include actuating rods 28 and 29 which are rotatable and displaceable by stationary hydraulic cylinders 26 and 27 and which can be latched into the associated plug portions 23 and which can remove the plug portions 23 from the receiving portions 22 and hold them during the tilting movement of the furnace.

Thus, in the embodiment illustrated in FIG. 1, before the furnace is tilted for slagging off or tapping, the electrode arms 8 are raised to the position shown in broken lines, the actuating rods 28 and 29 are extended from their associated cylinders 24 and 25 until the actuating rods engage into the plug portions 23, are there rotated, and then are retracted again, with the plug portions being entrained therewith, whereby separation of the releasable couplings is completed. Thereafter the furnace vessel can be tilted with the electrode arms, without the necessity for an additional length of heavy-current cable to be provided for this purpose. When the furnace vessel has been returned to its vertical position, the actuating rods are advanced until the plug portions 23 are firmly seated on the receiving portions 22, the catch connection is released by rotating the actuating rods 28 and 29, and the actuating rods are retracted again. The electrodes are thus electrically connected again to the associated phase windings of the transformer.

FIGS. 2 to 4 show three different detail views of the releasable coupling 21. The receiving portion 22 which is fixedly connected to the heavy-current bus bars 14 and 15 respectively includes a wedge-shaped opening 30 which receives a wedge-shaped plug portion 23 which is adapted to the opening 30. Disposed on the plug portion is an attachment member 31 in which the ends of four flexible cables 16 are inserted. The member 31 is received by a recess 32 in the receiving portion. At its upper end, the plug portion has a bore 33 with an annular groove 34 which is disposed at the end of the bore, and a slot 35 forming a communication with the annular groove 34. The actuating rods 28 and 29 which are provided with a transversely extending pin 36 at their end can be inserted into the plug portion through the slot 35 and locked after a rotary movement through 90°, as shown in FIG. 4, so that the plug portion is entrained with the actuating rod when the actuating rod is retracted. It will be understood that any other desired latching connecting means may be used.

FIGS. 5 and 6 show a further embodiment of a releasable coupling 37. It includes an electrically conducting receiving portion which is of a tongs-like configuration, with two arms 38 and 39 which are pivotal about a pivot axis 40 and which embrace an electrically conducting cylindrical plug portion 41. The outside contour of the plug portion 41 is adapted to the inside contour of the receiving portion. Four heavy-current bus bars 42 are secured to the plug portion, and four heavy-current bus bars 43 are secured to the receiving portion. The cables 44 are fixed at the end of the heavy-current bus bars 43. By means of an actuating rod 45, by which an opening mechanism (not shown) for the tongs-like receiving portion is controllable, the receiving portion may be moved towards the right and held until the furnace has performed its tilting movement.

I claim:

1. In combination: a support and a tiltable arc furnace spaced from said support, said arc furnace comprising electrodes, liftable electrode carrier arms supporting said electrodes, heavy-current conductors electrically connected to said electrodes and including substantially inflexible conductor means and flexible conductor means, releasable coupling means in said conductor means and including first coupling elements associated with said flexible conductor means and second coupling elements associated with said inflexible conductor means, and actuating and holding means provided at said support and including means for grasping, uncoupling and holding said first coupling elements.

2. The combination according to claim 1 wherein said releasable coupling means includes an electrically conducting receiving portion and an electrically conducting wedge-shaped or tapered plug portion, wherein said the receiving portion has an opening which is adapted to the form of the plug portion, wherein the plug portion has a catch mechanism for an actuating rod, and wherein said inflexible conductor means includes heavy-current bus bars which are secured to the electrode carrier arm and directly secured to the receiving portion, and wherein heavy-current bus bars carry the flexible conductor means and are secured to the plug portion.

3. The combination according to claim 1, wherein said releasable coupling includes an electrically conducting receiving portion and an electrically conducting wedge-shaped or tapered plug portion, wherein the receiving portion has an opening which is adapted to the form of the plug portion, wherein the plug portion has a catch mechanism for an actuating rod, and wherein said inflexible conductor means includes heavy-current bus bars which are secured to the electrode carrier arm and directly secured to the receiving portion, and wherein said flexible conductor means are directly secured to the plug portion.

4. The combination according to claim 1, wherein the releasable coupling includes an electrically conducting receiving portion which is of a tongs-like configuration, and an electrically conducting cylindrical plug portion whose outside contour is adapted to the inside contour of the receiving portion, and wherein the receiving portion includes a catch mechanism for an actuating rod, by means of which mechanism an opening mechanism for the tongs-like receiving portion is simultaneously controllable, and wherein heavy-current bus bars carry the flexible conductor means and are secured to the plug portion.

5. The combination according to claim 1, wherein the releasable coupling includes an electrically conducting receiving portion which is of a tongs-like configuration, and an electrically conducting cylindrical plug portion whose outside contour is adapted to the inside contour of the receiving portion, and wherein the receiving portion includes a catch mechanism for an actuating rod, by means of which mechanism an opening mechanism for the tongs-like receiving portion is simultaneously controllable, and wherein said flexible conductor means are directly secured to the plug portion.

6. The combination according to any one of claims 2 to 5, comprising stationary hydraulic cylinders, and wherein the actuating rods are rotatable and displaceable by said cylinders.

7. The combination of claim 1, wherein said actuating and holding means are disposed at the level of the upper limit position of the liftable electrode carrier arms.

8. The combination according to claim 1, wherein said actuating and holding means are disposed at a level below the upper limit position of the electrode carrier arms at a position directly above the highest position at which current must be supplied to said arc furnace during operation.

9. The combination according to any one of claims 1 to 8, comprising a furnace cover of a flat configuration.

* * * * *